US009320109B2

(12) United States Patent
Lai

(10) Patent No.: US 9,320,109 B2
(45) Date of Patent: Apr. 19, 2016

(54) COLOR TEMPERATURE ADJUSTING METHOD OF SOLID STATE LIGHT EMITTING DEVICE AND SOLID STATE LIGHT EMITTING DEVICE USING THE METHOD

(71) Applicant: Chih-Chen Lai, New Taipei (TW)

(72) Inventor: Chih-Chen Lai, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 617 days.

(21) Appl. No.: 13/677,210

(22) Filed: Nov. 14, 2012

(65) Prior Publication Data

US 2013/0169187 A1 Jul. 4, 2013

(30) Foreign Application Priority Data

Dec. 28, 2011 (TW) ..... 100149255

(51) Int. Cl.

| | |
|---|---|
| ***H05B 37/00*** | (2006.01) |
| ***H05B 37/02*** | (2006.01) |
| ***F21S 10/02*** | (2006.01) |
| ***H05B 33/08*** | (2006.01) |
| *F21K 99/00* | (2010.01) |
| *F21Y 101/02* | (2006.01) |
| *F21Y 105/00* | (2006.01) |
| *F21Y 113/00* | (2006.01) |

(52) U.S. Cl.

CPC ..... *H05B 37/02* (2013.01); *F21S 10/023* (2013.01); *H05B 33/086* (2013.01); *F21K 9/00* (2013.01); *F21Y 2101/02* (2013.01); *F21Y 2105/003* (2013.01); *F21Y 2105/008* (2013.01); *F21Y 2113/005* (2013.01)

(58) Field of Classification Search

CPC combination set(s) only.
See application file for complete search history.

(56) References Cited

U.S. PATENT DOCUMENTS

| | | | | |
|---|---|---|---|---|
| 2011/0159615 | A1* | 6/2011 | Lai | 438/29 |
| 2012/0001555 | A1* | 1/2012 | Tu et al. | 315/161 |
| 2012/0206050 | A1* | 8/2012 | Spero | 315/152 |

* cited by examiner

*Primary Examiner* — Douglas W Owens
*Assistant Examiner* — Monica C King
(74) *Attorney, Agent, or Firm* — Novak Druce Connolly Bove + Quigg LLP

(57) ABSTRACT

A color temperature adjusting method of solid state light emitting device, including steps: providing a main light source which emits main light of a first color temperature; providing an adjusting light source, wherein the adjusting light source comprises a red light source, a green light source and a blue light source; and adjusting currents applied to the adjusting light sources to obtain an adjusting light, wherein the adjusting light mixes with the main light of the main light source to obtain an outgoing light of a second color temperature. The second color temperature is different from the first color temperature. The outgoing light has a chromaticity coordinate at a Plank's curve on a CIE 1931 chromaticity coordinates chart.

6 Claims, 5 Drawing Sheets

COLOR TEMPERATURE ADJUSTING METHOD OF SOLID STATE LIGHT EMITTING DEVICE AND SOLID STATE LIGHT EMITTING DEVICE USING THE METHOD

TECHNICAL FIELD

The present disclosure relates to a color temperature adjusting method of a solid state light emitting device and a solid state light emitting device using the method, and more particularly, to a color temperature adjusting method of a solid state light emitting device whereby light generated by the solid state light emitting device can have a high CRI (color rendering index).

DESCRIPTION OF RELATED ART

Illuminating device plays an important role in our daily life. Illuminating devices of different color temperatures are required in different situations or in different circumstances. Solid state light emitting devices such as LEDs (light emitting diodes) and OLEDs (organic light emitting diodes) are gradually used as illuminating devices. A typical white LED usually uses a blue light LED chip to excite yellow phosphors to thereby obtain mixed white light. FIG. 1 shows a CIE 1931 (International Commission on Illumination) color coordinates chart. In the color coordinates chart, the curve P is the Planck's curve, and the dotted points on the Planck's curve represents certain color temperatures of white light. Line Y in FIG. 1 represents a color distribution of the typical white LED by changing a concentration of the yellow phosphor. The Line Y and the Planck's curve P intersect at 4600K point. That is to say, the white LED with the single yellow phosphor can produce the real white light at the color temperature of 4600K only when the single yellow phosphor has a specific concentration. To change the concentration of the single yellow phosphor from the specific concentration, the color temperature can be varied; however, the color of the light also departs from the real white color. Such white LED with real white light at only one color temperature cannot satisfy various color temperature needs. To change the color temperature of the white light of the conventional white LED, different methods are proposed. However, such methods each obtain white light with an adjusted temperature having a low color rendering index which cannot reflect a real color of an illuminated object.

What is needed, therefore, is a color temperature adjusting method of solid state light emitting device and illuminating device using the method which can overcome the described limitations.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the views.

DETAILED DESCRIPTION

Figure 1:
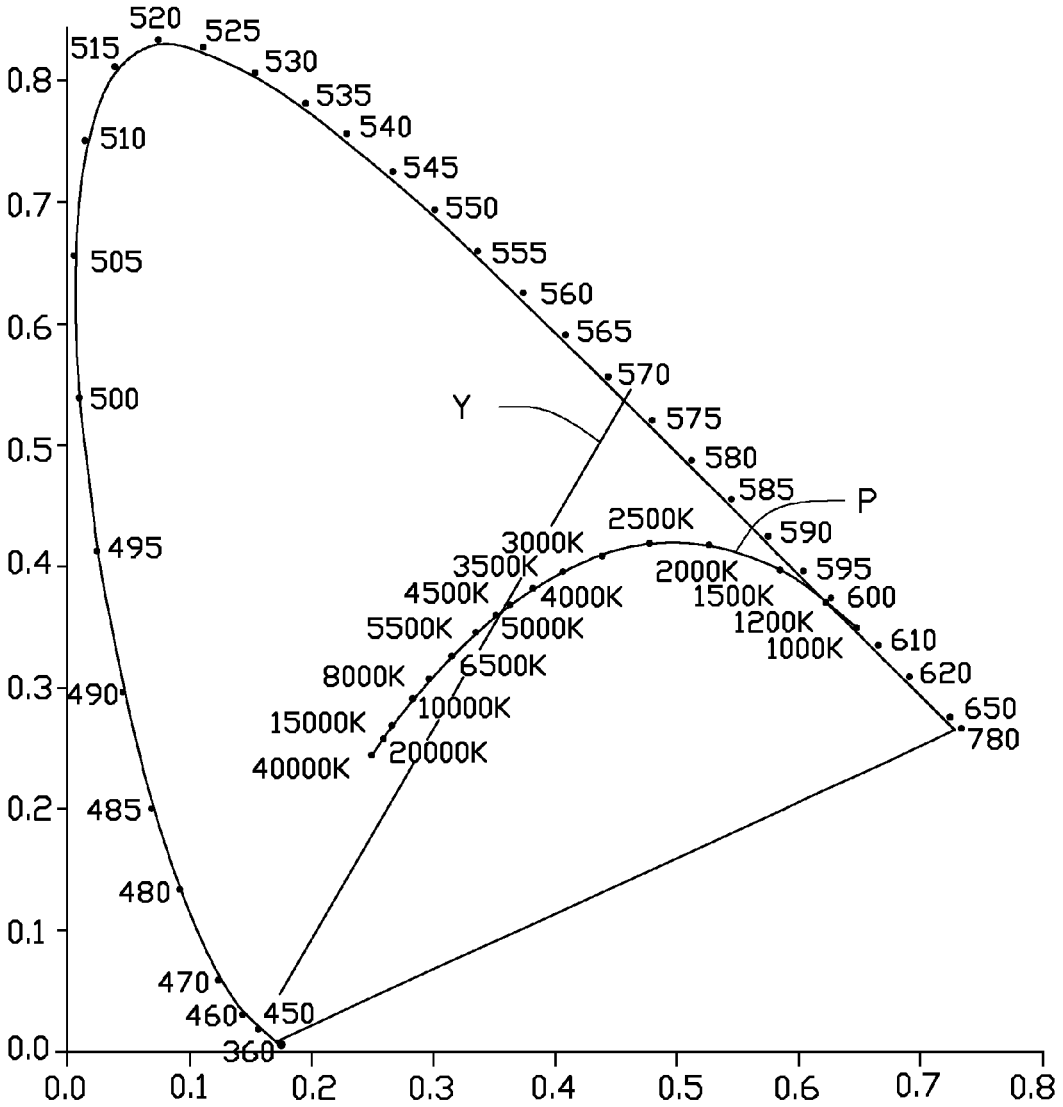
FIG. 1 (RELATED ART)
FIG. 1 shows a chromaticity line of light generated by a conventional white LED by changing a concentration of a single phosphor of the white LED and a Planck's curve on a CIE 1931 chromaticity coordinates chart.
Figure 2:
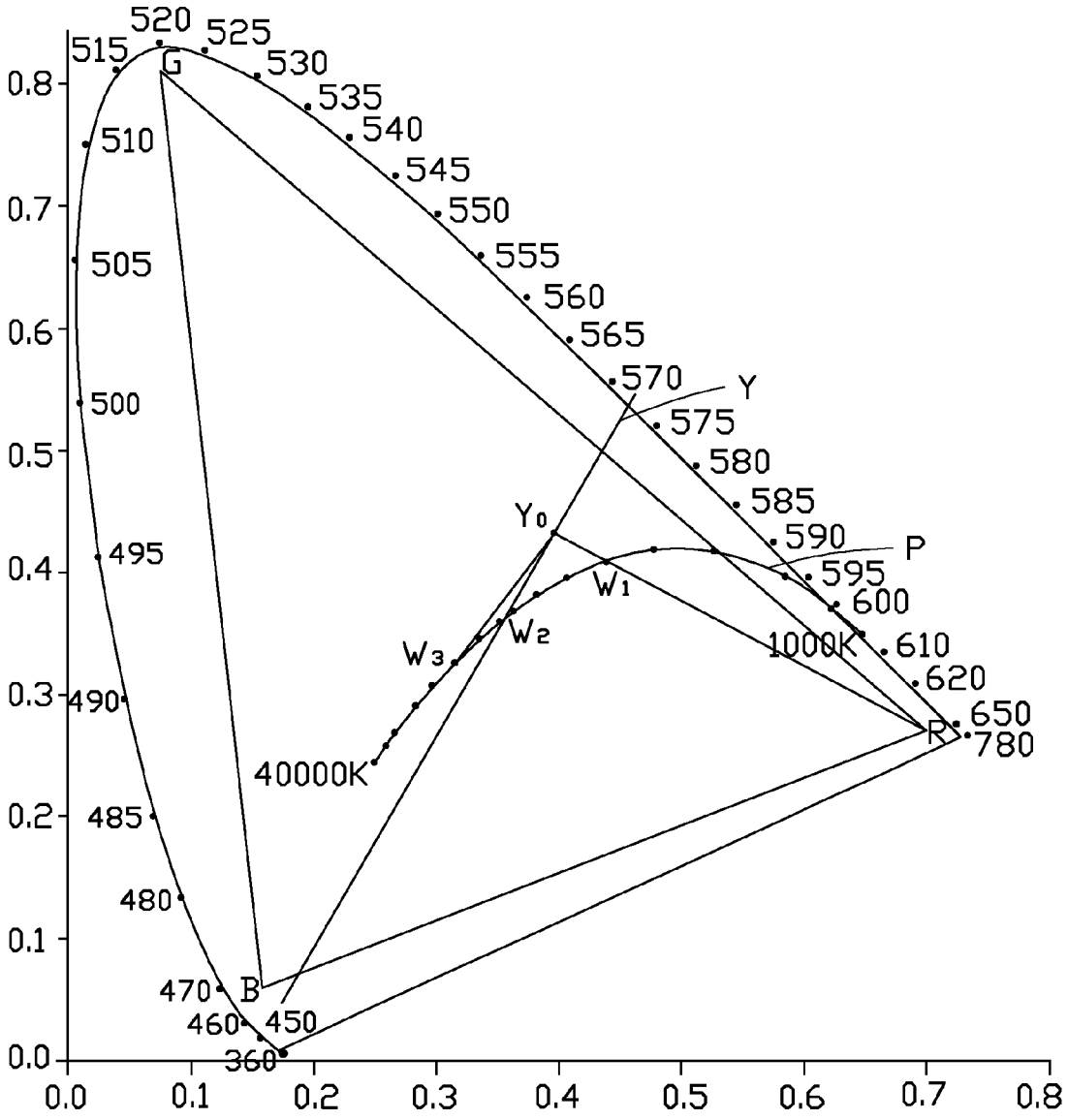
FIG. 2 shows the CIE 1931 chromaticity coordinates chart on which the chromaticity line Y of the conventional white LED is shown and light of an LED whose chromaticity is located on the chromaticity line Y is adjusted by a color temperature adjusting method in accordance with a first embodiment of the present disclosure to obtain white light whose color temperature is different from that of the conventional white LED.

Referring to FIG. 2, a color temperature adjusting method of solid state light emitting device of a first embodiment is shown. The method uses a main light source $Y_0$, a red light source, a green light source and a blue light source. In this embodiment, the main light source $Y_0$ includes a blue LED chip and a single yellow phosphor layer covering the blue LED chip. The phosphor in the phosphor layer has a specific concentration whereby light generated by the main light source $Y_0$ is deviated from the real white light which can be generated by the main light source $Y_0$ when the blue LED chip thereof is covered by the single yellow phosphor layer with another concentration of the phosphor. The real white light has a chromaticity coordinate located at the Planck's curve P and a color temperature of 4600K. A chromaticity coordinate of the main light source $Y_0$ in the CIE 1931 chromaticity coordinates chart deviates from the Planck's curve P. The main light source $Y_0$ has a coordinate (0.41, 0.43) of the CIE 1931 chromaticity coordinates chart. The red light source has a coordinate R(0.7, 0.275), the green light source has a coordinate G(0.175, 0.812) and the blue light source has a coordinate B(0.157, 0.57). By adjusting current applied to the red light source, the light source $Y_0$ and the red light source can obtain mixed light having any color falling on a straight line which connects the two coordinates $Y_0$ and R. The straight line defined by the coordinates $Y_0$ and R intersects the Planck's curve P at 3000K point wherein the mixed light is white light. Furthermore, by adjusting current applied to the blue light source in addition to the red light source, the main light source $Y_0$, the blue light source and the red light source can obtain mixed light having any color falling within a triangle defined by the color coordinates $Y_0$, R, B. The triangle intersects the Planck's curve P at 3000 k and 4600K points at each of which the mixed light is white light. That is to say, the color temperature between 3000K and 4600K can be obtained by changing the current applied to the red light source and the blue light source. In addition, by further adjusting current applied to the green light source in addition to the red light source and the blue light source, the main light source $Y_0$, the red light source, the blue light source and the green light source can obtain mixed light falling within a triangle defined by the color coordinates R, G, B. The triangle encompasses an end of the Planck's curve and intersects the Planck's curve at 2000K. Thus, the color temperature between 2000K and 40000K can be obtained by changing current applied to the red light source, the blue light source and the green light source. However, the color rendering index of the white light mixed by the light from the main light source $Y_0$, red, blue and green light sources must be further considered. For example, in order to obtain a color temperature $W_3$ (6500K) of the Planck's curve P, only the current applied to the blue light source needs to be changed without contribution of light of the red and green light sources; in other words, only the light from the blue light source is mixed with the light from the main light source $Y_0$, resulting in a low color rendering index of the mixed white light.

Figure 3:
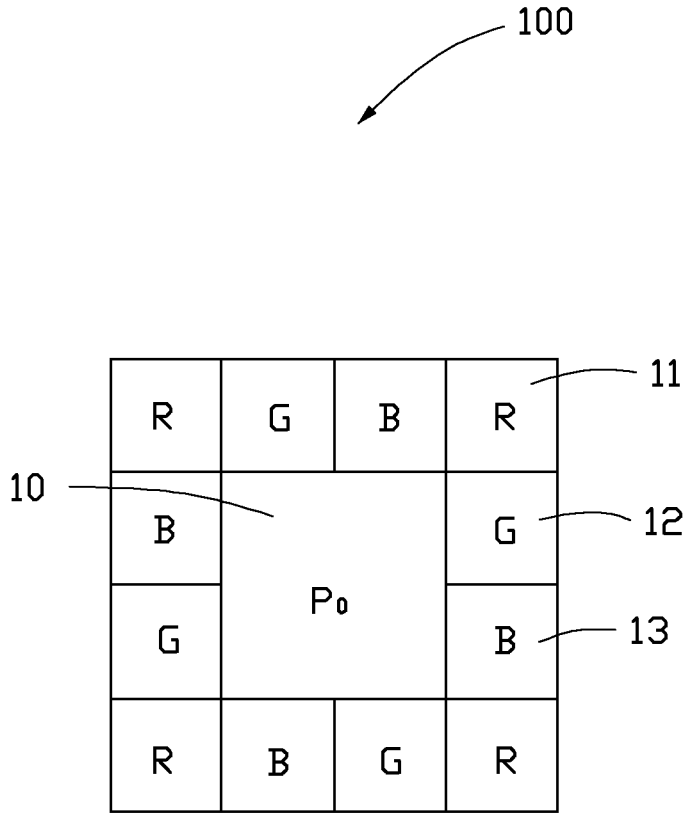
FIG. 3 is a schematic view showing a solid state light emitting device using the method shown in FIG. 2, wherein the solid state light emitting device has the LED surrounded by a plurality of red LEDs, green LEDs and blue LEDs.

Also referring to FIG. 3, a solid state light emitting device 100 using the above method is shown. The illuminating device 100 includes a main light source 10, a plurality of first adjusting light sources 11, a plurality of second adjusting light sources 12 and a plurality of third adjusting light sources 13. In this embodiment, the main light source 10 is located in a middle of the solid state light emitting device 100. The main light source 10 is an LED which emits light having a chromaticity coordinate the same as that of the main light source $Y_0$ in the CIE 1931 chromaticity coordinates chart. The first adjusting light sources 11 are four red LEDs which surround the light source 100. The second adjusting light sources 12 are four green LEDs which surround the light source 100. The third adjusting light sources 13 are four blue LEDs which surround the light source 10. The main light source 10 and the four first adjusting light sources 11, the four second adjusting light sources 12, the four third adjusting light sources 13 are arranged in a same plane. The four first adjusting light sources 11, the four second adjusting light sources 12, and the four third adjusting light sources 13 are alternately arranged around the main light source 10. The solid state light emitting device 100 is square wherein the four first adjusting light sources 11 are located at four corners of the device 100. Outgoing light of the illuminating device 100 can be adjusted by changing currents applied to the first adjusting light sources 11, the second adjusting light sources 12 and the third adjusting light source 13, until the mixed light of the light from the main light source 10 and the adjusting light sources 11, 12, 13 is white light having a color temperature between 2000K and 40000K. In order to get better mixing effect, the first adjusting light sources 11, the second adjusting light sources 12 and the third adjusting light sources 13 are located next to the main light source 10 as close as possible. Since there are four red, green and blue LEDs 11, 12, 13 surrounding the main light source 10 and every LED contributes to the formation of the mixed white light, the white light can have a better color rendering index.

Figure 4:
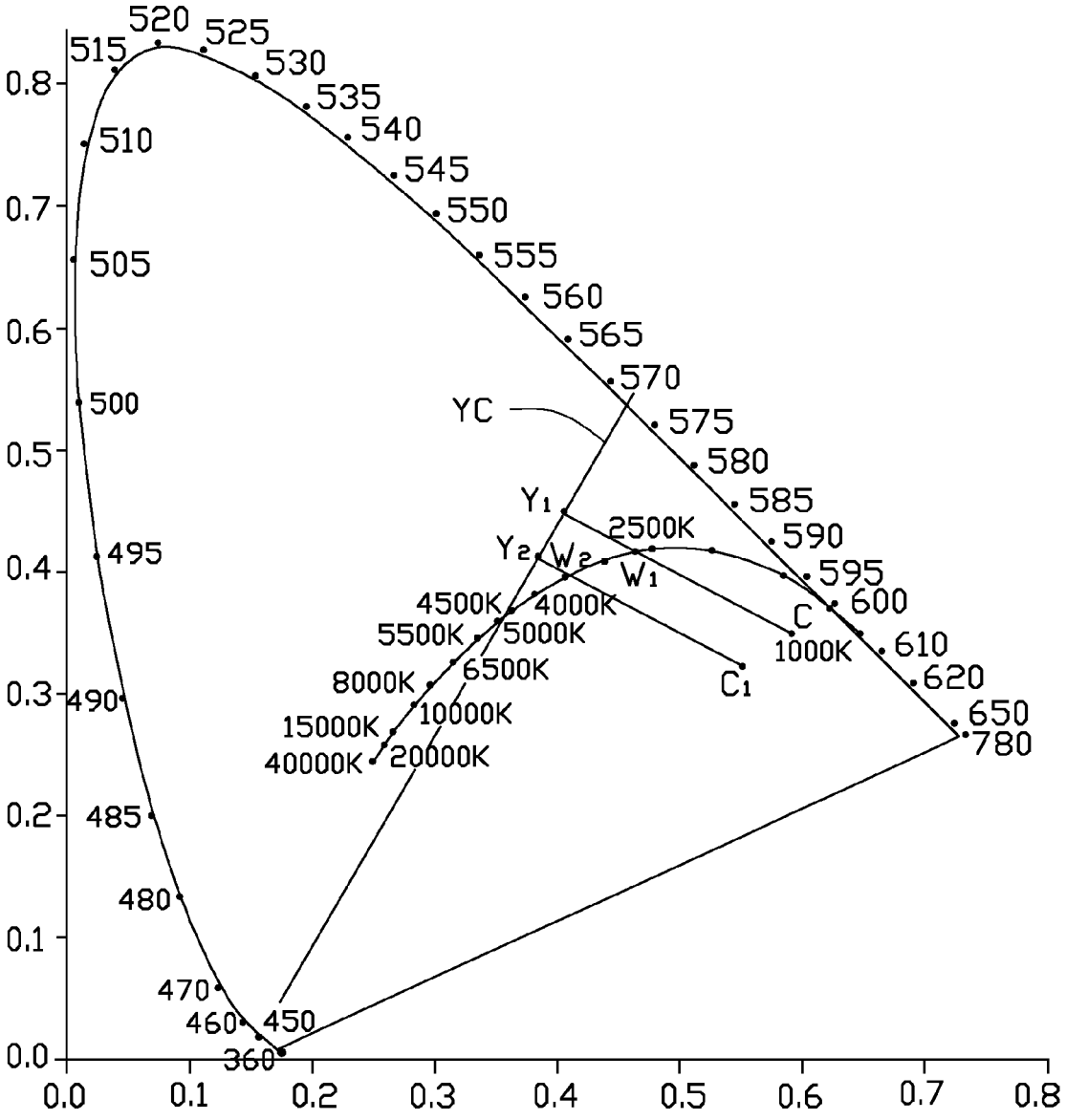
FIG. 4 shows a CIE 1931 chromaticity coordinates chart on which a chromaticity line YC of combined white LEDs is shown and the color temperature of white light of the combined white LEDs is adjusted by a color temperature adjusting method in accordance with a second embodiment of the present disclosure.

Referring to FIG. 4, a color temperature adjusting method of solid state light emitting device of a second embodiment is shown. The method uses a main light source consisting of at least two sub-main light sources each consisting of a blue LED chip covered by a yellow phosphor layer, a red light source, a green light source and a blue light source. In this embodiment, four sub-main light sources emitting lights of different color temperatures are used. The four sub-main light sources have color temperatures of 3500K, 4500K, 5500K and 15000K, respectively. Brightness of the four sub-main light sources can be adjusted by adjusting currents applied thereto. Current applied the sub-main light source having color temperature of 3500K is defined as $I_1$. Current applied to the sub-main light source having color temperature of 4500K is defined as $I_2$. Current applied to the sub-main light source having color temperature of 5500K is defined as $I_3$. Current applied to the sub-main light source having color temperature of 15000K is defined as $I_4$. Color temperature of mixed light of the four sub-main light sources is changeable by adjusting ratio of the currents $I_1$, $I_2$, $I_3$, $I_4$. The color temperature of the mixed light is more close to the color temperature of the sub-main light source which has more current applied thereto than that applied to the other light sources. For example, when the ratio of $I_1$:$I_2$:$I_3$:$I_4$ is 1:1:0.25:0, the color temperature of the mixed light of the sub-main light sources is 4100K, and the mixed light has a chromaticity coordinate located at a point $Y_1$ of the line YC of the CIE 1931 chromaticity coordinates chart, which is deviated from the Planck's curve P. A blue light source, a red light source and a green light source are provided to emit light which mix with the light from the sub-main light sources to obtain a white light with a required color temperature. By adjusting the current applied to the red light source, the current applied to the green light source and the current applied to the blue light source, the three light sources cooperatively produce mixed light which has a chromaticity coordinate C(0.61, 0.34) in the CIE 1931 chromaticity coordinates chart. The mixed light of the blue, red and green light sources further blends with the mixed light of the four sub-main light sources to obtain a finally mixed white light, which has a chromaticity coordinate $W_1$ falling on the Planck's curve P at 2800K point. That is to say, the mixed light produced by the four sub-main light sources which has a chromaticity coordinate deviating from the Planck's curve P, is changed to fall on the Planck's curve P by the blue, red and green light sources. Furthermore, the red light source, green light source and blue light source can increase a color rendering index of the finally mixed white light. For another example, when the ratio of $I_1$:$I_2$:$I_3$:$I_4$ is 1:1:1:0.365, the chromaticity coordinate of the mixed light of the four sub-main light sources is located at a point $Y_2$ (4700K) of the CIE 1931 chromaticity coordinates chart. By adjusting the current applied to the red light source, the current applied to the green light source and the current applied to the blue light source, the three light sources produce mixed light having a chromaticity coordinate located at point $C_1$ of the CIE 1931 chromaticity coordinates chart. The two mixed lights are blended to obtain finally mixed white light having a chromaticity coordinate falling on the Planck's curve P at point $W_2$, which is about 3500K.

In summary, the second embodiment illustrates a color temperature adjusting method of solid state light emitting device, which includes generating a first mixed light obtained by at least two sub-main light sources and a second mixed light which functions as an adjusting light and is obtained by a red light source, a green light source and a blue light source. The first and second mixed lights mix together to obtain an outgoing light has a good color rendering property. Furthermore, the chromaticity coordinate of the outgoing light is located at the Planck's curve, whereby the outgoing light is a real white light.

Figure 5:
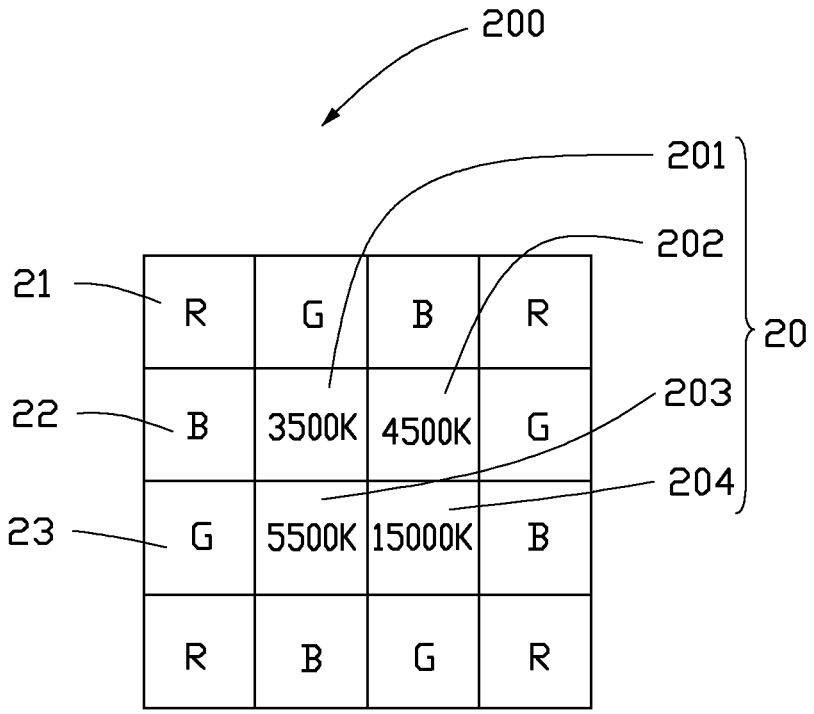
FIG. 5 is a schematic view of a solid state light emitting device using the method shown in FIG. 4, wherein the solid state light emitting device has white LEDs of different color temperatures surrounded by a plurality of red LEDs, green LEDs and blue LEDs.

Also referring to FIG. 5, a solid state light emitting illuminating device 200 using the above method is shown. The illuminating device 200 includes a main light source 20, a plurality of first adjusting light sources 21, a plurality of second adjusting light sources 22 and a plurality of third adjusting light sources 23. Each first adjusting light source 21 is a red light source. Each second adjusting light source 22 is a green light source. Each third adjusting light source is a blue light source. In this embodiment, the main light source 20 includes a first sub-main light source 201, a second sub-main light source 202, a third sub-main light source 203 and a fourth sub-main light source 204. The main light source is positioned in a middle of the illuminating device 200, with the four sub-main light sources 201, 202, 203, 204 arranged in a square array. The four sub-main light sources 201, 202, 203 and 204 are arranged in a same plane. In this embodiment, the illuminating device 200 includes four first adjusting light sources 21, four second adjusting light sources 22 and four third adjusting light sources 23 surrounding the main light source 20. The first sub-main light source 201 emits light of 3500K color temperature. The second sub-main light source 202 emits light of 4500K color temperature. The third sub-main light source 203 emits light of 5500K color temperature. The fourth sub-main light source 204 emits light of 15000K color temperature. Alternatively, the color temperatures of the four sub-main light sources 201, 202, 203 and 204 are not limited as described. Nevertheless, the lights emitted from the four sub-main light sources 201, 202, 203, 204 have chromaticity coordinates on the line YC. The color temperature of the main light source 20 can be adjusted by changing current applied to each of the four sub-main light sources 201, 202, 203 and 204. The main light source 20 and the four first adjusting light sources 21, four second adjusting light sources 22, four third adjusting light sources 23 are arranged in a same plane and form a square array. The four first adjusting light sources 21, four second adjusting light sources 22, four third adjusting light sources 23 are arranged alternately around the four sub-main light sources 201, 202, 203, 204 of the main light source 20, wherein the four first adjusting light sources 21 are located at four corners of the square. Each of the light sources 201, 202, 203, 204, 21, 22, 23 is an LED. Also, the brightness of the adjusting light sources 21, 22 and 23 can be adjusted by changing currents applied thereto. The light produced by the adjusting light sources 21, 22, 23 mix with the light produced by the main light source 20 to obtain an outgoing light, which has a required color temperature and a good color rendering property. In order to get better mixing effect, the first adjusting light sources 21, the second adjusting light sources 22 and the third adjusting light sources 23 are located next to the main light source 20 as close as possible. The outgoing light is white light and has a chromaticity coordinate located at the Plank's curve.

It is to be understood, however, that even though numerous characteristics and advantages of the embodiment(s) have been set forth in the foregoing description, together with details of the structures and functions of the embodiment(s), the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A color temperature adjusting method of solid state light emitting device comprising:

providing a main light sources consisting of at least two sub-main light sources emitting lights of different color temperatures;

adjusting currents applied to the at least two sub-main light sources to obtain a mixed emitting light; and providing an adjusting light source comprising a red light source, a green light source and a blue light source;

adjusting current each of the red light source, the green light source and the blue light source to obtain a mixed adjusting light, the adjusting light mixing with the mixed emitting light to obtain an outgoing light;

wherein the outgoing light has a color temperature different from a color temperature of the mixed emitting light and wherein a chromaticity coordinate of the outgoing light is at a Plank's curve on a CIE 1931 chromaticity coordinates chart, the main light source consists of four sub-main light sources, the four sub-main light sources emitting lights having different color temperatures, currents applied to the four sub-main light sources being $I_1$, $I_2$, $I_3$ and $I_4$, respectively, the color temperatures of the lights of the four sub-main light sources are 3500K, 4500K, 5500K and 15000K, respectively, and a ratio of $I_1$, $I_2$, $I_3$ and $I_4$ is 1:1:0.25:0, and the outgoing light has a color temperature of 2800K.

2. The method of claim 1, wherein the mixed emitting light has a chromaticity coordinate deviating from the Planck's curve on the CIE 1931 chromaticity coordinates chart.

3. The method of claim 1, wherein the main light source comprises four sub-main light sources arranged in a square array, and the red light source, the green light source and the blue light source each includes four light emitting diodes surrounding the main light source.

4. A color temperature adjusting method of solid state light emitting device comprising:

providing a main light sources consisting of at least two sub-main light sources emitting lights of different color temperatures;

adjusting currents applied to the at least two sub-main light sources to obtain a mixed emitting light;

providing an adjusting light source comprising a red light source, a green light source and a blue light source; and adjusting current each of the red light source, the green light source and the blue light source to obtain a mixed adjusting light, the adjusting light mixing with the mixed emitting light to obtain an outgoing light;

wherein the outgoing light has a color temperature different from a color temperature of the mixed emitting light and wherein a chromaticity coordinate of the outgoing light is at a Plank's curve on a CIE 1931 chromaticity coordinates chart, the main light source consists of four sub-main light sources, the four sub-main light sources emitting lights having different color temperatures, currents applied to the four sub-main light sources being $I_1$, $I_2$, $I_3$ and $I_4$, respectively, the color temperatures of the lights of the four sub-main light sources are 3500K, 4500K, 5500K and 15000K, respectively, and a ratio of $I_1$, $I_2$, $I_3$ and $I_4$ is 1:1:1:0.365, and the outgoing light has a color temperature of 3500K.

5. The method of claim 4, wherein the mixed emitting light has a chromaticity coordinate deviating from the Planck's curve on the CIE 1931 chromaticity coordinates chart.

6. The method of claim 4, wherein the main light source comprises four sub-main light sources arranged in a square array, and the red light source, the green light source and the blue light source each includes four light emitting diodes surrounding the main light source.

* * * * *